United States Patent [19]

Hambleton

[11] 4,009,821

[45] Mar. 1, 1977

[54] HOT-FOOD TRANSPORTING BOX

[75] Inventor: Thomas P. Hambleton, Kansas City, Mo.

[73] Assignee: International Paper Company, New York, N.Y.

[22] Filed: Feb. 25, 1976

[21] Appl. No.: 661,314

[52] U.S. Cl. ..... 229/36; 229/38

[51] Int. Cl.[2] ..... B65D 5/22

[58] Field of Search ..... 229/33, 35, 36, 45, 229/38; 215/DIG. 2

[56] References Cited

UNITED STATES PATENTS

| | | | |
|---|---|---|---|
| 1,052,564 | 2/1913 | Brown | 229/36 |
| 1,767,733 | 6/1930 | Brown | 229/33 |
| 1,923,065 | 8/1933 | Clemens | 229/36 |
| 2,185,764 | 1/1940 | Gagen | 229/45 X |
| 2,447,563 | 8/1948 | Buttery | 229/36 |
| 2,467,702 | 4/1949 | Smart | 229/38 X |
| 2,658,661 | 11/1953 | Aquino et al. | 229/36 |
| 3,029,996 | 4/1962 | Drummond | 229/36 |
| 3,368,735 | 2/1968 | Levi | 229/36 X |
| 3,924,051 | 12/1975 | Wiggins | 215/DIG. 2 |

FOREIGN PATENTS OR APPLICATIONS

| | | | |
|---|---|---|---|
| 528,545 | 10/1940 | United Kingdom | 229/DIG. 2 |

*Primary Examiner*—Davis T. Moorhead
*Attorney, Agent, or Firm*—Charles B. Smith; John A. Caruso

[57] ABSTRACT

A hot-food transporting box made of a semi-rigid material having top, back, bottom, and side panels attached to each other by fold line segments. The box also includes a multi-lamina front panel, which panel includes a first lamina extending downwardly from and attached to the top panel and a second lamina extending upwardly and attached to the bottom panel. When the box is erected, one of the front laminas is outside of, overlying, and releasably engaging the other lamina and the inside front lamina contacts the bottom or top panel to which the outside front lamina is attached, thereby retarding the sagging of the top panel of the box due to heat and moisture generated from the hot food contained therein. The inside front lamina is attached by a fold line segment to the front edge of one of the bottom and top panels. Portions of the inside front lamina and the front edge define two openings therebetween, each opening being in substantial alignment with the fold line segment and adjacent and generally perpendicular to a side panel of the box. The outside front lamina is attached by a fold line segment to the front edge of the other of the bottom and top panels and includes two tabs, each of which are folded inwardly into an opening, whereby the laminas are in releasable engagement. Inwardly directed flaps are provided on the side panels, the flaps being vertically oriented between the top and bottom panels of the box when the front laminas are in releasable engagement, so that the side panels are in a substantially 90° orientation to the top and bottom panels of the box and the box remains tightly closed to prevent loss of heat from the hot food contained therein.

4 Claims, 5 Drawing Figures

FIG.1
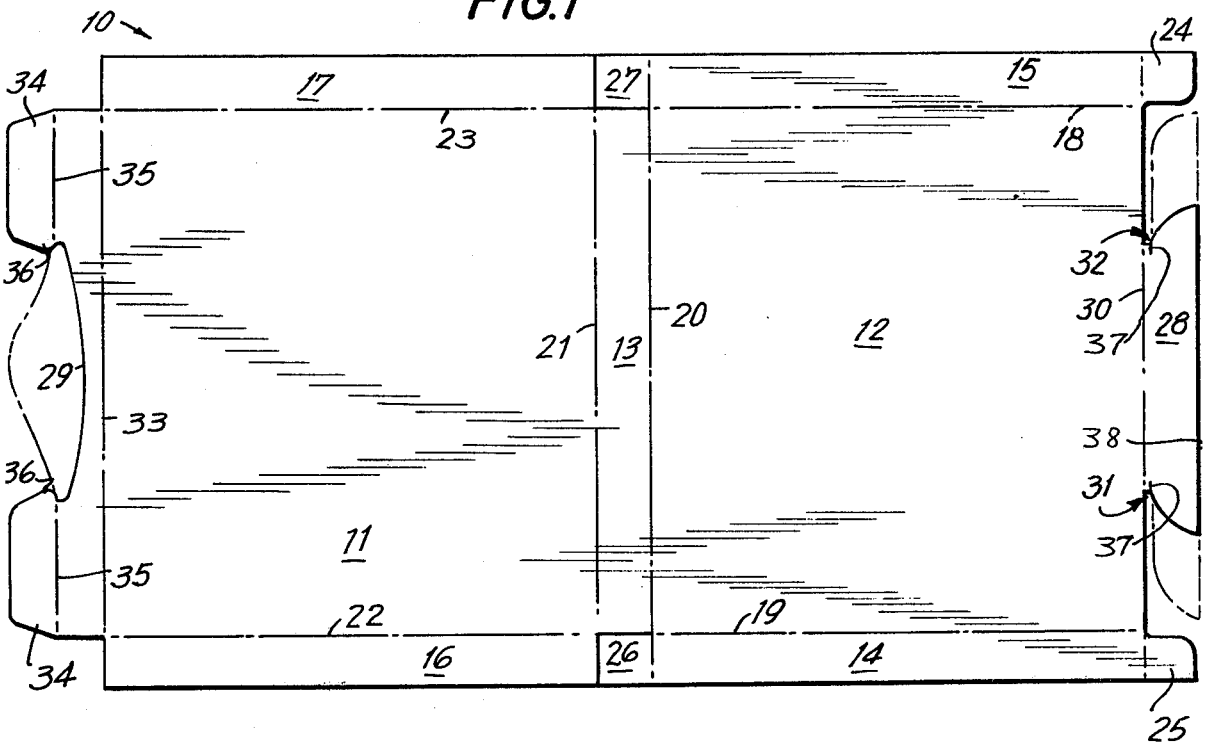
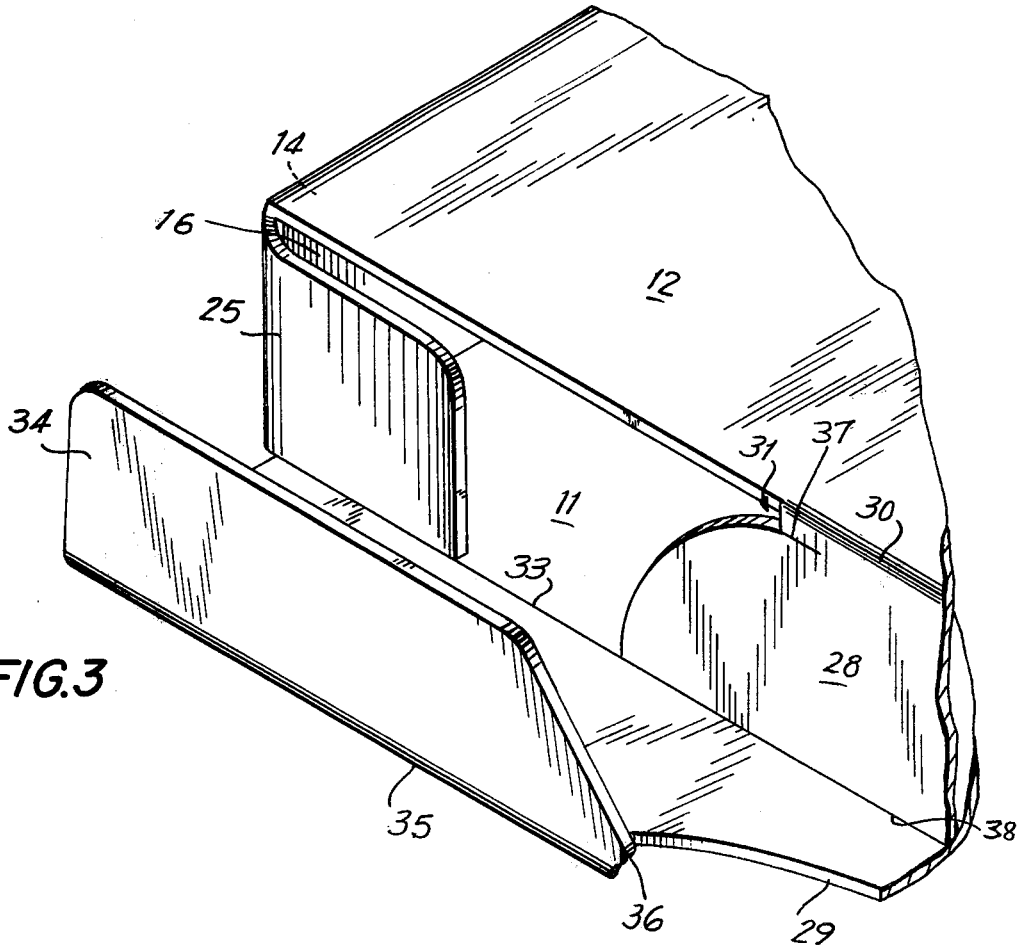
FIG.3

FIG.2
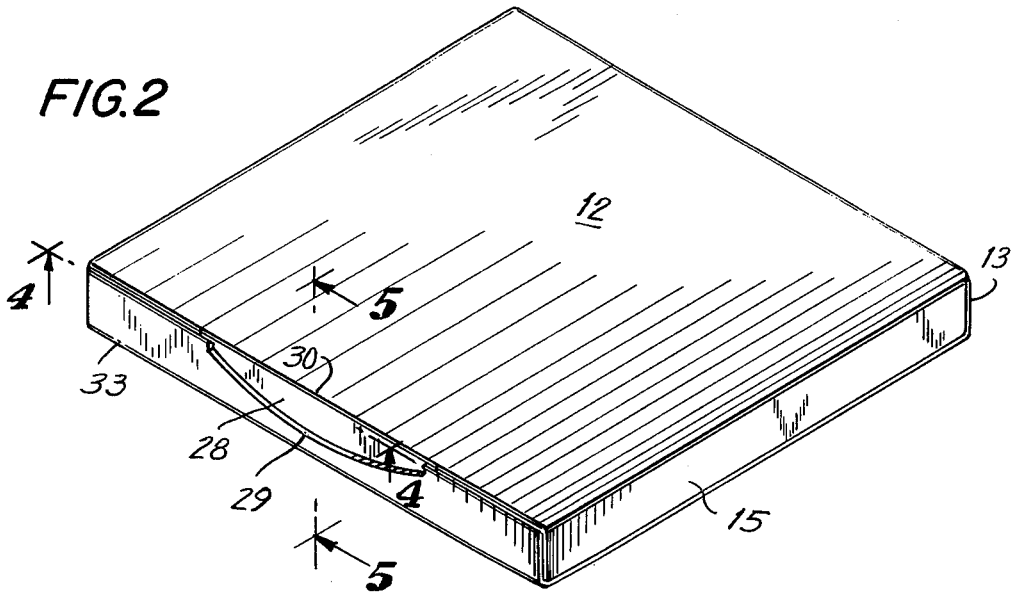
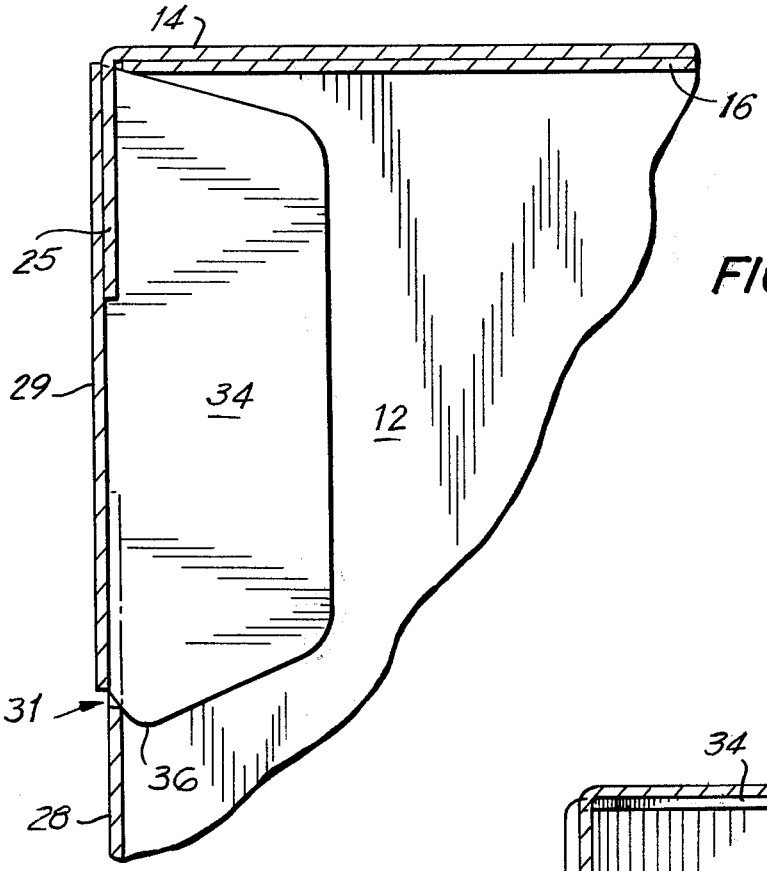
FIG.4
FIG.5
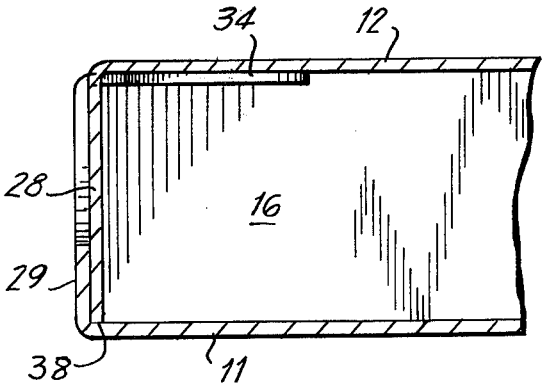

HOT-FOOD TRANSPORTING BOX

BACKGROUND OF THE INVENTION

This invention relates to a box for transporting hot foods, especially a food such as pizza. More particularly, the invention relates to a box capable of transporting a type of food that generates heat and moisture, which box is not substantially adversely affected by the generated heat and moisture.

Generally, foods of the type known as "take-out" foods are prepared and transported to the consumer while hopefully still hot. The requirements of a hot-food transporting box are that it be capable of maintaining food at substantially its preparation temperature for as long as possible and that it be capable of transporting the food in an undamaged condition. In the past, take out foods have been transported to the consumer in generally flexible, single thickness boxes. In particular with regard to pizza, the heat and moisture generated by the pizza has been found to cause a reduction in the integrity of such a box and a sagging of the top panel of the box, whereby the pizza is presented to the consumer in an unappetizing condition or is damaged. Further, a pizza box made of a single thickness material allows a substantial loss of heat from the pizza contained therein. In addition, the dimensions of a box for transporting a hot food such as pizza, where the box is much longer and wider than it is deep, further add to the possibility of heat loss from and of reduction of integrity of such a box.

To alleviate these problems, it is desirable that the material from which a hot-food transporting box is made be more substantial than the flexible, single thickness material commonly used. A box made of a double or triple thickness, semi-rigid material retains heat better than and is not affected by moisture and heat as greatly as a box made of a flexible single thickness material. In addition, it has been found that the hot-food transporting box of the present invention, because it is made of a semi-rigid material, can be provided with portions that support the top panel of the box so that this top panel does not sag to an appreciable extent, whereby damage to the hot food contained within the box results.

However, the use of a semi-rigid multi-thickness material in a hot-food transporting box creates problems, which have been solved by the box of the present invention. A semirigid material is more difficult to fold and when folded into an erected box has a tendency to reopen, which is not desirable because substantial heat loss from the hot food contained within such a box then occurs. The box of the present invention solves these problems; particularly by providing means for keeping the box tightly closed once it is erected. Thus, the advantages of a hot-food transporting box made of a semi-rigid material can be enjoyed without the inherent disadvantages of such a box.

Therefore, it is an object of this invention to provide a hot-food transporting box made of a material more substantial than the single thickness boxes known in the art. It is also an object of this invention to provide a hot-food transporting box made of a semi-rigid material with means for insuring that the box remains tightly closed after its erection. It is further an object of the present invention to provide a hot-food transporting box with means for reducing the sag in the top panel of the box to avoid damage to the hot food contained therein thereby maintaining the integrity of such a highly perishable product.

SUMMARY OF THE INVENTION

In accordance with this invention, a hot-food transporting box made of a semi-rigid material is provided. The box includes a top panel, a back panel attached to the top panel, a bottom panel attached to the back panel, side panels attached to the top and bottom panels, and a multi-lamina front panel. The front panel includes a first lamina attached to and extending downwardly from the top panel and a second lamina attached to and extending upwardly from the bottom panel. One of the first and second laminas is outside of, overlying, and releasably engaging the other of the first and second laminas, whereby the outside one of the first and second laminas is an outside front lamina and the other lamina is an inside front lamina. The inside front lamina contacts the one of the bottom and top panels to which the outside front lamina is attached, whereby this contact retards sagging of the top panel due to heat and moisture generated from hot food contained in the box.

The inside front lamina is attached by a fold line segment to a front edge of one of the bottom and top panels, portions of the inside front lamina and of the front edge partially define openings therebetween in substantial alignment with the fold line segment, and the outside front lamina is attached by at least one fold line segment to the front edge of the other of the top and bottom panels and comprises tabs folded inwardly into the opening, whereby the outside front lamina is in releasable engagement with the inside front lamina. The opening are defined adjacent and generally perpendicular to each side panel of the box and the outside front lamina comprises two tabs folded inwardly into the openings. The box is made of a paperboard material having a medium enclosed by two facings and the panels and laminas are attached to each other by fold line segments. Side panels attached to the one of the bottom and top panels to which the inside front lamina is attached have inwardly folded flaps being vertically oriented between the top and bottom panels, whereby the flaps maintain the side panels in a substantially 90° orientation to the top and bottom panels of the box.

In accordance with the present invention, a hot-food transporting box blank made of a semi-rigid material is also provided. The blank includes a top panel, a bottom panel, and a back panel having parallel front and back edges, the top and bottom panels being attached by fold line segments respectively to the back and front edges of the back panel. The blank also includes side panels attached by fold line segments to the side edges of the top and bottom panels, flaps attached to the front and back edges of the side panels attached to the top panel, and first and second laminas. The first lamina is attached by a first fold line segment to the front edge of the top panel, the first lamina and the front edge of the top panel having portions defining openings therebetween, the openings each being adjacent and generally perpendicular to each side panel attached to the top panel and being in substantial aligment with the first fold line segment. The second lamina is attached by a second fold line segment to the front edge of the bottom panel, the second lamina having portions defining two tabs, the tabs each having a diameter substantially the same as the diameter of each opening, the diameter of the tabs being measured along an axis parallel to the second fold line segment and the diameter of each opening being measured along an axis parallel to the first fold line segment.

BRIEF DESCRIPTION OF THE DRAWINGS

FIG. 1 is a view of a box blank from which an embodiment of the hot-food transporting box of the present invention is erected.

FIG. 2 is a perspective view of the hot-food transporting box erected from the blank illustrated in FIG. 1.

FIG. 3 is a partially cut-away perspective view of the hot-food transporting box erected from the blank illustrated in FIG. 1, showing the box in a partially open condition.

FIG. 4 is a partially cut-away cross sectional view of the box illustrated in FIG. 2 taken along lines 4—4 of FIG. 2.

FIG. 5 is a partially cut-away cross sectional view of the box illustrated in FIG. 2 taken along lines 5—5 of FIG. 2.

DESCRIPTION OF THE PREFERRED EMBODIMENTS

The hot-food transporting box of this invention is preferably made of a multi-thickness, semi-rigid material. Preferably, the material is paperboard having one medium enclosed by two facings. A paperboard material such as this is foldable, so that it can be erected into a box, but once erected, the box is not affected, in the manner described above, by heat and moisture generated from the hot-food contained therin as greatly as a single thickness, flexible material box. The box of this invention can also be made of a single thickness material, where the material has essentially the same thickness as the multi-thickness box described above, but such a box should also be semi-rigid. For ease of folding the material to erect the box, the fold line segments connecting the portions of the box, described in detail below, are preferably perforated. It is contemplated that none of the segments need be perforated and also that only some of the segments be perforated, which choice is within the skill of one versed in the art to determine from this disclosure which segments need be perforated to form a box satisfying a particular need.

An embodiment of the hot-food transporting box of the present invention is erected from the blank 10 illustrated in FIG. 1. Blank 10 includes a bottom panel 11, top panel 12, a back panel 13, and side panels 14–17. The various panels are connected by fold line segments 18–23. For ease of description, the edges of the panels are referred to as front, back, and side edges with reference to the box shown in FIG. 2. Segments 22, 23, 18 and 19 connect the side edges of bottom and top panels 11 and 12 to the side edges of side panels 14–18. Segments 20 and 21 connect the back edge of top panel 12 with the back edge of back panel 13 and the back edge of bottom panel 11 with the front edge of back panel 13. As illustrated in FIG. 1, it will generally be desired that these various edges are parallel or perpendicular to each other. Attached to the front and back edges of side panels 14 and 15 are flaps 24–27. As discussed in detail below, the front panel of the hot-food transporting box of this invention has a multi-lamina front panel. This front panel is formed from the first and second laminas 28 and 29, as shown in FIG. 1.

First lamina 28 is attached by a first fold line segment 30 to the front edge of panel 12. Lamina 28 and the front edge have portions defining openings, generally indicated at 31 and 32, between the lamina and the edge. Openings 31 and 32 are adjacent and generally perpendicular to side panels 14 and 15 and are in substantial alignment with segment 30. It is apparent from FIG. 1 that the openings defined by lamina 28, the front edge of panel 12, and flaps 24 and 25 include the above-mentioned openings 31 and 32. The shape and dimensions of these larger openings can be varied within the scope of this invention as long as openings 31 and 32 are provided having a shape and the dimensions that will accommodate the means for releasably engaging the laminas 28 and 29 together, which means is discussed in detail below. For example, lamina 28 could be lengthened in size along an axis parallel to segment 30, as shown in dotted line in FIG. 1, so that openings 31 and 32 become more greatly defined between the front edge of panel 12 and lamina 28.

Second lamina 29 is attached by a second fold line segment 33 to the front edge of panel 11. Lamina 29 has portions defining two tabs 34, which are each defined to have a diameter substantially the same as the diameter of openings 31 and 32. Tabs 34, in cooperation with openings 31 and 32, are the means for releasably engaging laminas 28 and 29 together in the box of this invention. Measuring the diameter of tabs 34 along an axis parallel to segment 33 and the diameter of openings 31 and 32 along an axis parallel to segment 30, it is apparent that tabs 34 can be inserted into openings 31 and 32. Lamina 29 also has a cut-out portion defined between tabs 34. This cut-out portion is preferably made in lamina 29 to facilitate opening of the box once it is erected, but it is to be understood that the cut-out portion need not be as deep as shown in FIG. 1. If desired, this cut-out portion may be modified so that when the box is erected a section of this cut-out portion remains standing above the height of the box to act as a finger grip for easy opening of the box. Also the tabs may be formed without the need for any cut-out portion if lamina 29 is provided with approximate separation lines perpendicular to segment 30, which lines would allow tabs 34 to be broken away from the remaining portions of lamina 29.

FIG. 2 illustrates the embodiment of the hot-food transporting box of the present invention erected from the blank of FIG. 1. Top panel 12 and bottom panel 11 are folded along segments 20 and 21, so that panel 11 is parallel with panel 12. Side panels 16 and 17 are then folded upwardly and side panels 14 and 15 are folded downwardly on the outside of panels 16 and 17. Flaps 24–27 are then folded inwardly, so that the flaps are vertically oriented between panels 11 and 12. If desired, this partially erected box may be stored and filled before completing the erection of the box. To more clearly illustrate the manner in which the front laminas are releasably engaged and erection of the box is completed a cutaway portion of FIG. 2 is illustrated in FIG. 3.

As shown in FIG. 3, fold line segments 35 are provided between each tab 34 and the remaining portions of lamina 29. To completely erect the box, lamina 28 is folded downwardly, tabs 34 are folded on segments 35, lamina 29 is folded upwardly, and one tab 34 is inserted into opening 31 and on the other side of the front of the box, the other tab 34 is inserted into opening 32. Thus tabs 34 are parallel and abut the under side of top panel 12 while the other portions of lamina 29 are perpendicular to bottom panel 11 and are pressed against flaps 24 and 25 and lamina 28. Preferably, the pizza to be transported will be placed upon bottom panel 11 so that tabs 34 do not interfere with it.

To further insure that tabs 34 remain engaged in openings 31 and 32, a lip 36 is preferably provided on each tab 34, as shown in FIG. 3. If desired, a slit 37 may be provided extending inwardly from each opening 31 and 32 to further lock tabs 34.

Thus, upon insertion of tabs 34 in openings 31 and 32, lamina 29 overlies and releasably engages lamina 28. This type of releasable engagement is particularly advantageous when the box is made of a semi-rigid material because it provides a positive engagement rather than just a frictional engagement of the laminas. For example, in a box made of a flexible, single thickness material, frictional engagement between a downwardly depending front lamina and upwardly extending front lamina may be sufficient to keep the box closed. However, in a box made in accordance with the present invention, such frictional engagement would not be sufficient because of the inherent tendency of the box to unfold. The essential L-shape of lamina 29 reduces the tendency of tabs 34 to withdraw from openings 31 and 32 and allow the box to unfold.

The above described releasable locking mechanism also provides an advantage, in cooperation with flaps 24–27, in maintaining side panels 14–17 in a substantially 90° orientation to top and bottom panels 12 and 11.

As shown in FIG. 4, side panel 16 is enclosed within side panel 14 and flap 25 when the box is closed. Also, upon inserting tabs 34 in openings 31 and 32, as shown in FIG. 3, flap 25 is substantially captured between bottom panel 11 and tab 34, so that the tendency for flap 25 to lift upwardly and unfold out of the box is substantially reduced. Therefore, both side panels 14 and 16 are held closely together to reduce the loss of heat from a pizza or food product contained within the box. Taken together with the pressing of lamaina 29 against 28, this results in a hot-food transporting box which satisfies most of the requirements discussed above.

To satisfy the other requirement of a hot-food transporting box discussed above, i.e. that the box have means for preventing its top panel from sagging which results in damage to food contained within the box, inside front lamina 28 contacts bottom panel 11, whereby sagging of panel 12 due to heat and moisture generated from the food is retarded.

FIG. 5 particularly illustrates the contact of lamina 28 with bottom panel 11. A free edge of lamina 28, edge 38 contacts the upper surface of panel 11 at approximately the fold line segment 33. This contact helps prevent panel 12 from sagging in the middle of the box. This problem is particularly acute in a pizza box, where because of the peculiar dimensions of a pizza, the ratio of the height of lamina 28 to the length of panel 12 which length is measured from the back to the front of the box, is about 1 to about 10. Of course, the length of free edge 38 is preferably as great as possible to reduce the possibility of sagging of panel 12 as much as possible. A preferred ratio of the length of free edge 28 to the length of panel 12 is about 1–2.5 to about 3.

It is to be understood that the box illustrated in FIG. 2 as another embodiment of the box of this invention could be turned over so that the top and bottom panels of the box, as described above, are interchanged. In this event, the designations provided above are utilized only for the purpose of understanding the relationships between the various structures in the box of this invention. It is contemplated that other modifications of the hot-food transporting box of this invention will occur to those skilled in the art after study of this disclosure.

What is claimed is:

1. A hot-food transporting box made of a semi-rigid material comprising a top panel, a back panel attached to the top panel, a bottom panel attached to the back panel, and side panels attached to the top and bottom panels;

a multi-lamina front panel, the front panel comprising an inside front lamina attached by a fold line segment to a front edge of the top panel and an outside front lamina attached by a fold line segment to the front edge of the bottom panel, the side panels attached to the top panel having inwardly folded flaps vertically oriented between the top and bottom panels, the outside front lamina comprising tabs, portions of the inside front lamina, of the front edge of the top panel, and of the flaps defining an opening adjacent each side panel of the box, the tabs being folded inwardly into the openings, whereby the outside front lamina is in releasable engagement with the inside front lamina, and the inside front lamina contacts the bottom panel, whereby this contact retards sagging of the top panel due to any heat and moisture generated from hot food contained in the box.

2. The box of claim 1 wherein the ratio of the height of the inside front laminat to the length of the top panel, the length being measured from the back to the front of the box, is about 1 to about 10.

3. The box of claim 1 wherein the semi-rigid material of which the box is made is paperboard having a medium enclosed by two facings.

4. The box of claim 1 wherein the panels and laminas are attached to each other by perforated fold line segments.

* * * * *

UNITED STATES PATENT AND TRADEMARK OFFICE

CERTIFICATE OF CORRECTION

PATENT NO. : 4,009,821

DATED : March 1, 1977

INVENTOR(S) : Thomas P. Hambleton

It is certified that error appears in the above-identified patent and that said Letters Patent are hereby corrected as shown below:

Col. 2, line 32 - "opening" should be -- openings --;

Col. 2, line 34 - "opening" should be -- openings --;

Col. 2, line 45 - after "box" delete "." and insert -- and contribute to the complete definition of the openings in which the tabs are inserted and --;

Col. 2, line 62 - "aligment" should be -- alignment --;

Col. 3, line 31 - "therin" should be -- therein --;

Col. 6, line 8 - "28" should be -- 38 --;

Col. 6, line 46 - "laminat" should be -- lamina --.

Signed and Sealed this

Seventeenth Day of May 1977

[SEAL]

*Attest:*

RUTH C. MASON
*Attesting Officer*

C. MARSHALL DANN
*Commissioner of Patents and Trademarks*